US005185030A

United States Patent [19]

Miller et al.

[11] Patent Number: 5,185,030

[45] Date of Patent: Feb. 9, 1993

[54] METHOD FOR PRODUCING EXTRAFINE PURE METAL POWDER

[75] Inventors: Michael J. Miller; James N. Christini, both of Towanda; Eric F. Husted, Ulster, all of Pa.

[73] Assignee: GTE Products Corporation, Stamford, Conn.

[21] Appl. No.: 811,274

[22] Filed: Dec. 20, 1991

[51] Int. Cl.[5] ..... B22F 1/00

[52] U.S. Cl. ..... 75/359; 75/343; 75/363; 75/369

[58] Field of Search ..... 75/343, 359, 357, 363, 75/369

[56] References Cited

U.S. PATENT DOCUMENTS 2,721,135 10/1955 Wimberly ..... 75/356

4,178,172 12/1979 Tiitinen et al. ..... 75/359

*Primary Examiner*—R. Dean

*Assistant Examiner*—Robert R. Koehler

*Attorney, Agent, or Firm*—Elizabeth A. Levy

[57] ABSTRACT

A method of making extrafine pure elemental metal powder from a highly malleable pure elemental metal powder. The pure elemental metal powder is oxidized, ground to a desired average particle size, reduced in a reducing atmosphere to a pure elemental metal powder, and then sieved to obtain the desired fraction of extrafine pure elemental metal powder.

6 Claims, No Drawings

METHOD FOR PRODUCING EXTRAFINE PURE METAL POWDER

TECHNICAL FIELD

This invention relates to the production of extrafine pure elemental metal powders from highly malleable pure elemental metal powders.

BACKGROUND OF THE INVENTION

Certain malleable pure elemental metals, such as cobalt, nickel or copper, are also highly malleable when formed into pure metal powders. Attempts to reduce the average particle size of such malleable powders are often futile, as the powder particles are easily deformed and tend to flatten when subjected to particle size reduction processes.

U.S. Pat. No. 2,721,135 to Wimberly discloses a method of producing metal powders which have a closely controlled particle size distribution for use in powder metallurgy applications (column 1, lines 31–35). Too great a fraction of fine-size particles may make them unsuitable for such powder metallurgy applications (column 1, lines 53–65). An objective of the Wimberly process is thus to increase the average particle size of the metal powders as well as to closely control the particle size distribution.

The disclosed source of these powders is a metal-bearing material, typically a metallic oxide from an ore such as magnetite (column 2, lines 68–71). In the Wimberly process, the metallic oxide is sintered, an effect of which is to increase the particle size of the oxide powder (column 2, lines 36–40). The sintered material is then crushed and/or ground to the desired particle size distribution (column 2, lines 17–20 and lines 47–50). The ground oxide is then reduced by means of a reducing agent (column 2, lines 50–52), an effect of which is to agglomerate the ground oxide particles (column 2, line 53). The reduced material is then reground or milled to obtain a metal powder having the desired particle size characteristics (column 2, lines 53–56). The only metal disclosed in Wimberly is iron.

Methods for producing fine cobalt metal powders are also disclosed in U.S. Pat. Nos. 4,798,623 to Cheresnowsky, 4,705,559 to Miller, 4,348,224 to Gingerich et al., and 4,093,450 to Doyle et al. In these patents, a cobalt-containing precipitate is obtained from aqueous solutions of cobalt-containing materials. The precipitate is then reduced to form cobalt metal powders.

SUMMARY OF THE INVENTION

We have determined that the average particle size may be reduced in highly malleable pure elemental metal powders, such as powders of cobalt, nickel and copper, by performing the particle size reduction operation on an oxide of the malleable metal powder and then reducing the metal oxide back to a metal powder. The resulting metal powder has the desired particle size and has not been deformed in the particle size reduction process.

An important distinction between the Wimberly process and that of this invention is the use of elemental metal powders instead of metallic oxides of ores as the starting material. The process of this invention results in a smaller average particle size and a greater percentage of large-size particles, thereby increasing the particle size distribution, whereas Wimberly's process reduces the particle size distribution.

In accordance with one aspect of the invention, there is provided a method of producing extrafine pure elemental metal powder from a starting material consisting of a highly malleable pure elemental metal powder, comprising the steps of: oxidizing said highly malleable pure elemental metal powder, grinding the resulting oxide, reducing the ground oxide in a reducing atmosphere to obtain a pure elemental metal powder, the steps of oxidizing, grinding and reducing having the effect of decreasing the average particle size while increasing the particle size distribution of said pure elemental metal powder, and sieving said pure elemental metal powder to obtain the desired fraction of said extrafine pure elemental metal powder.

In accordance with another aspect of the invention, there is provided a method of producing extrafine pure cobalt metal powder from a starting material consisting of a highly malleable pure cobalt metal powder, comprising the steps of: oxidizing said highly malleable pure cobalt metal powder, grinding the resulting cobalt oxide, reducing the ground cobalt oxide in a reducing atmosphere to obtain a pure cobalt metal powder, the steps of oxidizing, grinding and reducing having the effect of decreasing the average particle size while increasing the particle size distribution of said pure cobalt metal powder, and sieving said pure cobalt metal powder to obtain the desired fraction of said extrafine pure elemental cobalt powder.

DETAILED DESCRIPTION OF THE INVENTION

The following non-limiting examples are presented.

EXAMPLE I

A sample of pure cobalt metal powder was heated in a furnace in air at a temperature of between 850° C. and 950° C. for 48 hours. X-ray diffraction studies of the heated material indicated that the cobalt metal powder was converted to a mixture of cobalt oxides, including CoO and $Co_3O_4$.

The oxidized material was then ground in a shatter box for a few minutes to obtain the desired particle size distribution.

The ground material was then reduced in a 100% hydrogen atmosphere at 500° C. for two hours until no more cobalt oxide was detected by X-ray diffraction and all the material had been converted to a cobalt metal powder.

EXAMPLE II

The method of Example I was followed, except that the ground oxide was reduced at a temperature of 600° C. instead of 500° C.

Table I indicates the weight percent of treated and untreated cobalt metal powder retained on a series of sieves. The mesh sizes of the sieves are designated as 100, 120, 170, and so forth through 400. The corresponding sieve openings are given in microns underneath each mesh size. Higher mesh size numbers correspond with smaller sieve openings. The "+" indicates that the given weight percent of particles were larger than the sieve openings and thus were retained on the sieve.

The data in Table I indicate that while none of the untreated powder was retained on the largest sieve (100 mesh, or 149 microns), 94% was retained on the smallest sieve (400 mesh, or 37 microns). Of the powder treated by the method of Example I (reduced at 500° C.), only 10% was retained on the largest sieve, while 27% was retained on the smallest sieve. Of the powder treated by the method of Example II (reduced at 600° C.), 39% was retained on the largest sieve, while 73% was retained on the smallest sieve.

The treated powders contained not only a higher fraction of fine-size particles, but also a higher fraction of large-size particles and thus a broader distribution of particle sizes generally when compared to the untreated powder. While none of the untreated powder was larger than 100 mesh, 10% of the powder of Example I, and 39% of the powder of Example II, was larger than 100 mesh. In the given particle size range of 100 mesh to 400 mesh (37 to 149 microns), the difference in the amount of untreated powder retained on the largest and smallest sieves was 94%. In other words, 94% of the particles were within this particle size range. However, only 17% of the Example I powder fell within that particle size range, while 34% of the Example II powder fell within that particle size range.

TABLE I

AVERAGE PARTICLE SIZE OF TREATED AND UNTREATED COBALT METAL POWDERS, EXPRESSED AS WEIGHT PERCENT RETAINED ON A GIVEN SIEVE SIZE

| | UNTREATED | EX. I | EX. II |
|---|---|---|---|
| +100 (149 u) | 0% | 10% | 39% |
| +120 (125 u) | 1 | 14 | 46 |
| +170 (88 u) | 17 | 20 | 57 |
| +200 (74 u) | 39 | 23 | 64 |
| +270 (53 u) | 77 | 24 | 67 |
| +325 (44 u) | 83 | 26 | 69 |
| +400 (37 u) | 94 | 27 | 73 |

While there has been shown and described what are at present considered the preferred embodiments of the invention, it will be obvious to those skilled in the art that various changes and modifications may be made therein without departing from the scope of the invention as defined by the appended claims.

We claim:

1. A method of producing extrafine pure elemental metal powder from a starting material consisting of a highly malleable pure elemental metal powder, comprising the steps of: oxidizing said highly malleable pure elemental metal powder, grinding the resulting oxide, reducing the ground oxide in a reducing atmosphere to obtain a pure elemental metal powder, the steps of oxidizing, grinding and reducing having the effect of decreasing the average particle size while increasing the particle size distribution of said pure elemental metal powder, and sieving said pure elemental metal powder to obtain the desired fraction of said extrafine pure elemental metal powder.

2. A method according to claim 1 wherein said highly malleable pure elemental metal powder is selected from the group consisting of cobalt, nickel and copper.

3. A method of producing extrafine pure cobalt metal powder from a starting material consisting of a highly malleable pure cobalt metal powder, comprising the steps of: oxidizing said highly malleable pure cobalt metal powder, grinding the resulting cobalt oxide, reducing the ground cobalt oxide in a reducing atmosphere to obtain a pure cobalt metal powder, the steps of oxidizing, grinding and reducing having the effect of decreasing the average particle size while increasing the particle size distribution of said pure cobalt metal powder, and sieving said pure cobalt metal powder to obtain the desired fraction of said extrafine pure elemental cobalt powder.

4. A method according to claim 3 wherein said highly malleable pure cobalt metal powder is oxidized at between 850° C. and 950° C. in air for a sufficient time to convert substantially all of said starting material to cobalt oxide.

5. A method according to claim 3 wherein said ground cobalt oxide is reduced at 500° C. in a hydrogen atmosphere for a sufficient time to convert substantially all of said ground cobalt oxide to a pure cobalt metal powder.

6. A method according to claim 3 wherein said cobalt oxide comprises a mixture of cobalt oxides which includes CoO and $Co_3O_4$.

* * * * *